US008293440B2

(12) United States Patent
Nakamura et al.

(10) Patent No.: US 8,293,440 B2
(45) Date of Patent: Oct. 23, 2012

(54) WHITE TONER FOR ELECTROSTATIC IMAGE DEVELOPMENT, ELECTROSTATIC IMAGE DEVELOPING AGENT, TONER CARTRIDGE, PROCESS CARTRIDGE AND IMAGE FORMING APPARATUS

(75) Inventors: Yukiaki Nakamura, Kanagawa (JP); Yasuo Kadokura, Kanagawa (JP); Noriyuki Mizutani, Kanagawa (JP); Atsushi Sugawara, Kanagawa (JP); Yusuke Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 347 days.

(21) Appl. No.: 12/780,529

(22) Filed: May 14, 2010

(65) Prior Publication Data

US 2011/0159422 A1 Jun. 30, 2011

(30) Foreign Application Priority Data

Dec. 25, 2009 (JP) ..... 2009-295268

(51) Int. Cl.
*G03G 9/09* (2006.01)

(52) U.S. Cl. ..... 430/108.1; 430/107.1

(58) Field of Classification Search ..... 430/104–108.1
See application file for complete search history.

(56) References Cited

U.S. PATENT DOCUMENTS

2008/0069598 A1* 3/2008 Murakami et al. ..... 399/265
2009/0305160 A1* 12/2009 Gal et al. ..... 430/112

FOREIGN PATENT DOCUMENTS

| | | |
|---|---|---|
| JP | A-5-107798 | 4/1993 |
| JP | A-8-339095 | 12/1996 |
| JP | A-10-10771 | 1/1998 |
| JP | A-2001-49146 | 2/2001 |
| JP | A-2002-108021 | 4/2002 |

OTHER PUBLICATIONS

Reade Advanced Materials (http://www.reade.com/Particle_Brief-ings/spec_gra.html), 2006 Reade Advanced Materials.*
Sekisui Plastics Co., Ltd. (http://www.tech-p.com/en/products/in-dex.html), 2007 Sekisui Plastics Co., Ltd.*

* cited by examiner

*Primary Examiner* — Christopher Rodee
*Assistant Examiner* — Rashid Alam
(74) *Attorney, Agent, or Firm* — Oliff & Berridge, PLC

(57) ABSTRACT

The present invention provides a white toner for electrostatic image development, including a binder resin, a first white pigment and a second white pigment, the specific gravity D1 of the first white pigment satisfies the relationship of about 3.5<D1<about 6.0, and the specific gravity D2 of the second white pigment satisfies the relationship of about 0.3<D2<about 1.2.

12 Claims, 1 Drawing Sheet

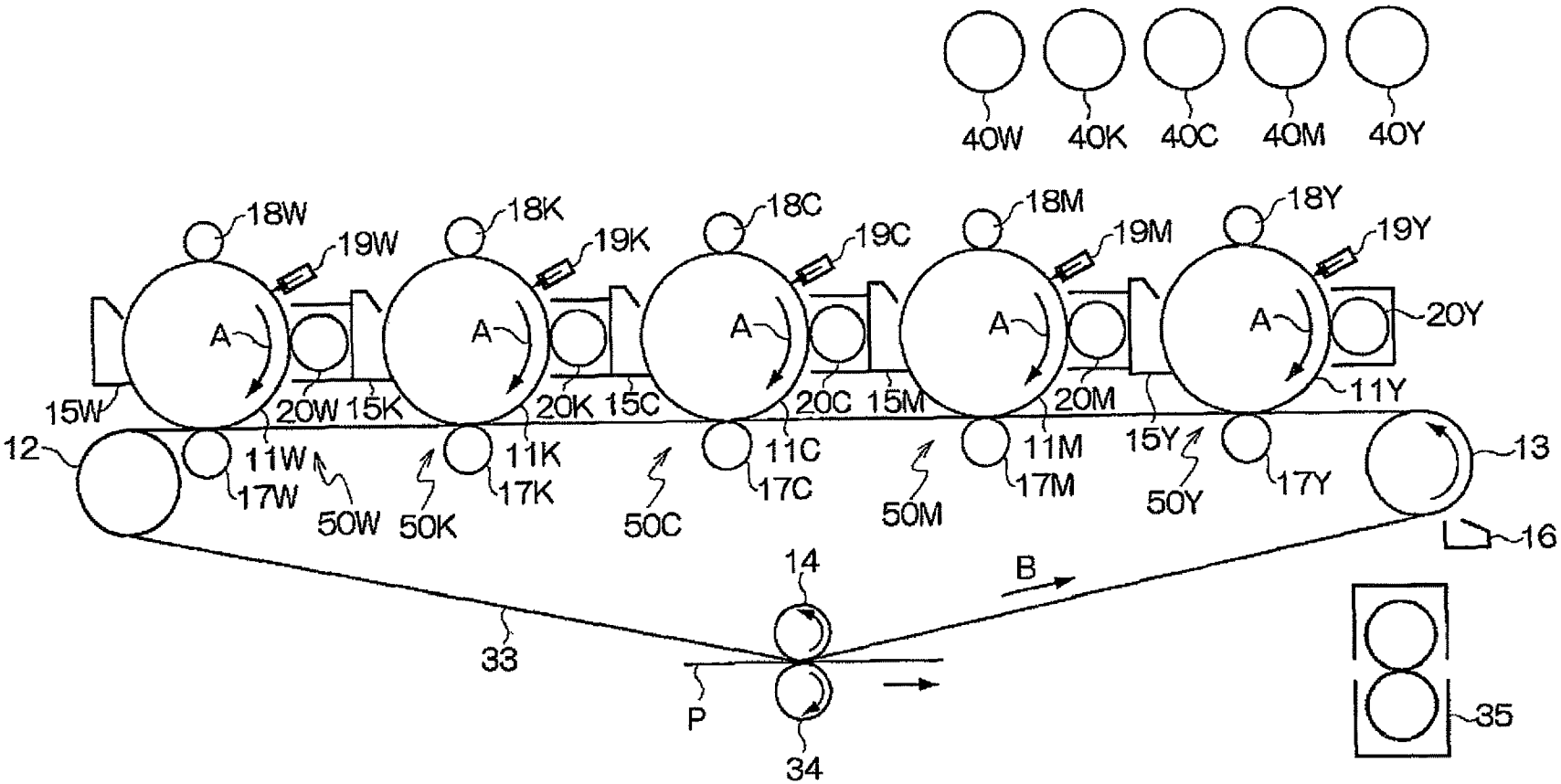
40Y
40M
40C
40K
40W
18Y
19Y
20Y
11Y
17Y
15Y
50Y
18M
19M
20M
11M
17M
15M
50M
18C
19C
20C
11C
17C
15C
50C
18K
19K
20K
11K
17K
15K
50K
18W
19W
20W
11W
17W
15W
50W
A
B
P
12
13
14
16
33
34
35

WHITE TONER FOR ELECTROSTATIC IMAGE DEVELOPMENT, ELECTROSTATIC IMAGE DEVELOPING AGENT, TONER CARTRIDGE, PROCESS CARTRIDGE AND IMAGE FORMING APPARATUS

CROSS-REFERENCE TO RELATED APPLICATION

This application is based on and claims priority under 35USC 119 from Japanese Patent Application No, 2009-295268 filed on Dec. 25, 2009.

BACKGROUND OF THE INVENTION

1. Technical Field

The present invention relates to a white toner for electrostatic image development, an electrostatic image developing agent, a toner cartridge, a process cartridge, and an image forming apparatus.

2. Related Art

Conventionally, it has been proposed a white toner containing at least a binder resin and thermosetting small resin particles or small resin particles having a higher softening point than that of the binder resin, a toner for electrophotographic image formation characterized by containing white filler particles, or a toner for electrophotographic image formation characterized by containing white filler particles having a specific gravity of 2.5 to 2.7 and a volume average particle size of 1 to 100 μm at a proportion of 0.01 to 0.2% by weight of the total weight of toner.

Further, it has been proposed a toner for electrostatic latent image development containing toner particles formed from a colorant and a binder resin, of which the angle of repose X (°), volume average particle size D50 (μm) and loose apparent specific gravity (AD) (g/cc) satisfy particular conditions, a white coloring material composition containing a white powder having, on the surface of base particles, at least one layer of a coating film constituted of aggregates formed of crystallized microparticles capable of giving white color by scattering reflection of light and having voids in between the crystallized microparticles, and a white toner that is fixed on a transfer material, characterized by having a white part in the core and having a transparent part on the outer side.

SUMMARY

According to an aspect of the invention, there is provided a white toner for electrostatic image development, including a binder resin, a first white pigment and a second white pigment, the specific gravity D1 of the first white pigment satisfies the relationship of about 3.5<D1<about 6.0, and the specific gravity D2 of the second white pigment satisfies the relationship of about 0.3<D2<about 1.2.

BRIEF DESCRIPTION OF THE DRAWINGS

Exemplary embodiments of the invention will be described in detail based on the following figures, wherein:

FIG. 1 is a schematic constitutional diagram showing an example of the image forming apparatus according to an exemplary embodiment of the invention.

DETAILED DESCRIPTION OF THE INVENTION

Hereinafter, the toner for electrostatic image development, electrostatic image developing agent, toner cartridge, process cartridge and image forming apparatus according to an exemplary embodiment of the invention will be described in detail.

(White Toner for Electrostatic Image Development)

The white toner for electrostatic image development (hereinafter, simply referred to as "white toner") related to the exemplary embodiment is constituted to include a binder resin and white pigments. Furthermore, the white toner contains, as white pigments, at least a first white pigment having a specific gravity D1 which satisfies the relationship of 3.5 or about 3.5<D1<6.0 or about 6.0, and a second white pigment having a specific gravity D2 which satisfies the relationship of 0.3 or about 0.3<D2<1.2 or about 1.2.

Here, as the method of using the white toner, an image may be drawn by underlaying a white toner image on a colored image transfer receiver such as color paper or black paper, or an image transfer receiver made of a transparent material or the like; in other words, forming a concealing layer with the white toner, and then forming a color image thereon, so as to reduce the influence of the background color and to enhance color developing properties. A further possible method includes drawing a white toner image itself on a colored image transfer receiver such as a color paper or a black paper, or an image transfer receiver made of a transparent material or the like.

The coloring power or masking power of white color in this white toner image is based on the principle that light is scattered by making use of the difference in the refractive index between a white pigment and a binder resin, and it is not intended to essentially block the transmittance of light. Therefore, for example, in order to secure practically sufficient concealability and to obtain a color image exhibiting satisfactory coloring, the white pigment is often added in a larger amount than the binder resin, or the white toner image is formed to have a large thickness.

Accordingly, there is a tendency for the flexural strength of a toner image formed with a white toner (a fixed image thereof) to decrease.

This is thought to be because, since the white pigment used in a white toner image (fixed image thereof) is generally an inorganic material (for example, titanium oxide, zinc oxide, zinc sulfide or the like) or the like, the specific gravity of the white pigment is larger than that of the binder resin, and thus the dispersibility of the white pigment in the image becomes poor. Since the high specific gravity of the white pigment makes it prone to settle in the direction of gravity, it is thought that the pigment particles easily aggregate locally, and thereby the flexural strength decreases.

Thus, when at least two kinds of white pigments having the constitution shown above, that is, at least two kinds of white pigments satisfying the relationship with respect to specific gravity as disclosed above, are used in combination in the white toner according to the exemplary embodiment, a white toner image having high flexural strength may be obtained.

Although the reason for this is not completely clear, it is speculated that when a first white pigment with high specific gravity, which tends to have relatively high coloring power and masking power, is used in combination with a second white pigment having lower specific gravity than that of the first white pigment, then at the time of fixation of the white toner image, local aggregation of the first white pigment with a higher specific gravity caused by the tendency thereof to settle in the direction of gravity, is inhibited by the second white pigment which has a lower specific gravity. It is also speculated that the dispersibility of the first white pigment is improved, so that the white toner image is fixed such that the white pigments are all well dispersed without unevenness.

Furthermore, for the speculated reason described above, it is also thought that, in addition to the flexural strength, the white toner according to the exemplary embodiment may have favorable image fixing properties with respect to image breakage (cracks in the image) and mechanical strength.

Hereinafter, the details of the white toner according to the exemplary embodiment will be explained.

The white toner according to the exemplary embodiment is composed of, specifically, white toner particles containing, for example, a binder resin, white pigments, and if necessary, a release agent or other additives, and an external additive.

First, the white pigment will be explained.

For the white pigment, at least two kinds, namely, a first white pigment and a second pigment, are used in combination.

The first white pigment is a white pigment, of which the specific gravity D1 satisfies the relationship of 3.5 or about 3.5<D1<6.0 or about 6.0, preferably the relationship of 3.5 or about 3.5<D1<5.0 or about 5.0, and more preferably the relationship of 3.5 or about 3.5<D1<4.5 or about 4.5.

It is thought that as the specific gravity of this first white pigment satisfies the above range, a difference in the specific gravity between the first white pigment and the second white pigment is secured, and local aggregation of the first white pigment is inhibited by the second white pigment, so that a state in which all of the white pigments are dispersed evenly over the white toner image, is obtained.

On the other hand, the second white pigment is a white pigment, of which the specific gravity D2 satisfies the relationship of 0.3 or about 0.3<D2<1.2 or about 1.2, preferably the relationship of 0.3 or about 0.3<D2<1.0 or about 1.0, and more preferably the relationship of 0.3 or about 0.3<D2<0.8 or about 0.8.

It is thought that as the specific gravity of this second white pigment satisfies the above range, a state in which the second white pigment has a higher specific gravity than that of the binder resin is secured, together with the difference in specific gravity between the first white pigment and the second white pigment, so that maldistribution of the second white pigment itself is suppressed. It is also thought that local aggregation of the first white pigment is inhibited by the second white pigment so that a state in which all of the white pigments are dispersed evenly over the white toner image, is obtained.

Here, it is desirable that both the first white pigment and the second white pigment have higher relative densities than that of the binder resin.

It is preferable that the content of the first white pigment be larger than the content of the second white pigment, and that the total content of the first white pigment and the second white pigment be from 20% by weight or about 20% by weight to 50% by weight or about 50% by weight (preferably from 20% by weight or about 20% by weight to 35% by weight or about 35% by weight, and more preferably from 25% by weight or about 25% by weight to 35% by weight or about 35% by weight) with respect to the total solid contents of the toner. Thereby, a white toner image having high coloring power and masking power may be obtained. Furthermore, a decrease in the mechanical strength of a white toner image due to excessive containment of white pigment, is suppressed.

Here, the content ratio of the first white pigment and the second white pigment (first white pigment:second white pigment) is, on a weight basis, suitably from 1:1 to 4:1, preferably from 1:1 to 3:1, and more preferably from 1:1 to 2:1.

Furthermore, the content of the first white pigment may be selected to be from 10% by weight or about 10% by weight to 30% by weight or about 30% by weight (preferably from 15% by weight or about 15% by weight to 30% by weight or about 30% by weight, and more preferably from 20% by weight or about 20% by weight to 30% by weight or about 30% by weight) with respect to the total solid contents of the toner.

On the other hand, the content of the second white pigment may be selected to be from 10% by weight or about 10% by weight to 30% by weight or about 30% by weight (preferably from 10% by weight or about 10% by weight to 25% by weight or about 25% by weight, and more preferably from 10% by weight or about 10% by weight to 20% by weight or about 20% by weight) with respect to the total solid contents of the toner.

When these relationships of content are satisfied, a white toner image having high flexural strength and high coloring power and masking power may be obtained.

The term specific gravity means a value measured by the following method.

The specific gravity is measured by the following operation using a Le Chatelier specific gravity bottle, according to Section 5-2-1 of JIS-K-0061.

(1) 250 ml of ethyl alcohol is placed in a Le Chatelier specific gravity bottle, and the volume is adjusted to bring the meniscus to the marked position.

(2) The specific gravity bottle is immersed in a constant-temperature water bath, and when the temperature of the liquid reached 20.0±0.2° C., the position of the meniscus is read with precision on the scale of the specific gravity bottle (degree of precision 0.0025 ml).

(3) 100 g of a sample is weighed.

(4) The weighed sample is added into the specific gravity bottle, and bubbles are removed.

(5) The specific gravity bottle is immersed in the constant-temperature bath, and when the temperature of the liquid reached 20.0±0.2° C., the position of the meniscus is read with precision on the scale of the specific gravity bottle (degree of precision 0.0025 ml).

(6) The specific gravity is calculated by the following expressions:

$$D=W/(L2-L1) \quad \text{Expression:}$$

$$S=D/0.9982 \quad \text{Expression:}$$

wherein D represents the density of the sample (g/cm$^3$, 20° C.); S represents the specific gravity of the sample (20° C.); W represents the apparent weight of the sample (g); L1 represents the reading value for the meniscus before the addition of the sample into the specific gravity bottle (ml, 20° C.); L2 represents the reading value for the meniscus after the addition of the sample into the specific gravity bottle (ml, 20° C.); and 0.9982 represents the density (g/cm$^3$) of water at 20° C.

The specific gravity is controlled by the composition (material) type or structure of the white pigments.

The first white pigment is not particularly limited, specifically as long as the pigment satisfies the above relationship for specific gravity, but examples thereof include inorganic pigments (for example, titanium dioxide, barium sulfate, zinc oxide, lead titanate, potassium titanate, barium titanate, strontium titanate, zirconia, antimony trioxide, white lead, zinc sulfide, barium carbonate).

On the other hand, the second white pigment is not particularly limited, specifically as long as the pigment satisfies the above relationship for specific gravity, but examples thereof include organic pigments (for example, polystyrene resin particles, urea-formalin resin particles, polyacrylic resin particles, polystyrene/acrylic resin particles, polystyrene/butadiene resin particles, alkyl bis melamine resin particles, and the like), and irregularly shaped particles (flat-shaped resin particles, microparticle aggregate-shaped particles, red corpuscle type resin particles, through-hole type resin particles, and hollow shaped particles). Particularly, a pigment having a hollow structure may be suitably used as the second white pigment. Since the pigment having a hollow structure is a pigment which readily satisfies the relationship for specific gravity, and also has high coloring power and masking power, when this pigment is used, a white toner image having high coloring power and masking power may be obtained. This is speculated to be because a pigment having a hollow structure is constituted of a shell part and a hollow part, and the refractive index of the interface between the shell part and the air layer becomes larger than that of a pigment having a non-hollow structure, thereby the coloring power and masking power being increased.

Examples of this pigment having a hollow structure include hollow inorganic pigments (for example, hollow silica, hollow titanium oxide, hollow calcium carbonate, hollow zinc oxide, zinc oxide tubular particles), and hollow organic particles (styrene resin, acrylic resin, styrene/acrylic resin, styrene/acrylic acid ester/acrylic acid resin, styrene/butadiene resin, styrene/methyl methacrylate/butadiene resin, ethylene/vinyl acetate resin, acrylic/vinyl acetate resin, acrylic/maleic acid resin, and the like). Among these, the hollow inorganic particles (particularly, hollow silica) have an advantage that they have high coloring power and masking power, while hollow resin particles are likely to acquire a flat shape when pressure (for example, pressure due to fixation or the like) is added, and the resulting white toner image has enhanced glossiness.

As the white pigment, a white pigment other than the first white pigment and the second white pigment (referred to as a third white pigment) may also be used. This third white pigment may be used to an extent of not impairing the effect of using the first white pigment and the second white pigment in combination, and specific examples thereof include heavy calcium carbonate, light calcium carbonate, aluminum hydroxide, satin white, talc, calcium sulfate, magnesium oxide, magnesium carbonate, amorphous silica, colloidal silica, white carbon, kaolin, calcined kaolin, delaminated kaolin, aluminosilicates, sericite, bentonite, smectite, and the lime.

The volume average particle sizes of the white pigments are suitably 1 μm or less or about 1 μm or less, and preferably from 100 nm or about 100 nm to 300 nm or about 300 nm, for both the first white pigment and the second white pigment.

Here, the measurement of the volume average particle size is carried out using a laser diffraction type particle size distribution analyzer (trade name: LA-700, manufactured by Horiba, Ltd.). The method for measurement is such that a sample in the form of a dispersion liquid is adjusted to have a solids content of 2 g, and ion-exchanged water is added thereto to adjust the volume to 40 ml. This dilution is introduced into a cell to obtain an appropriate concentration, the cells is left to stand for 2 minutes, and when the concentration in the cell becomes stable, measurement is made. The volume average particle size of every obtained channel is cumulated from the smallest particle size sample, and the particle size at 50% cumulative volume is designated as the volume average particle size.

The binder resin will be explained.

The binder resin may be any known resin material, but a polyester resin is particularly preferred. The polyester resin is a resin obtainable mainly by a polycondensation reaction between polyvalent carboxylic acids and polyhydric alcohols.

The polyester resin may be produced by subjecting a polyhydric alcohol and a polyvalent carboxylic acid to a condensation reaction according to a conventional method. For example, it is preferable to produce the polyester resin by adding and mixing the polyhydric alcohol and the polyvalent carboxylic acid, and a catalyst as necessary in a reaction vessel equipped with a thermometer, a stirrer and a downward flow type condenser; heating the mixture at from 150° C. to 250° C. in the presence of an inert gas (nitrogen gas or the like); continuously removing any side-produced low molecular weight compounds from the reaction system; terminating the reaction at a time point where a specific acid value has been reached; and cooling the system to obtain the desired reaction product.

Here, the binder resin is preferably a resin having a weight average molecular weight (Mw) of preferably from 5,000 to 1,000,000, and more preferably from 7,000 to 500,000, a number average molecular weight (Mn) of preferably from 2,000 to 10,000, and a molecular weight distribution of preferably from 1.5 to 100, and more preferably from 2 to 60, based on molecular weight measurement according to a gel permeation chromatography (GPC) method of a tetrahydrofuran (THF)-soluble fraction.

This weight average molecular weight is obtained by measuring a THF-soluble fraction in the THF solvent using a gel permeation chromatographic analyzer (trade name: GPC HLC-8120, manufactured by Tosoh Corp.) and a column (trade name: TSKGEL SUPER HM-M (15 cm), manufactured by Tosoh Corp.), and calculating the molecular weight using a molecular weight calibration curve produced with monodisperse polystyrene standard samples.

The glass transition temperature of the binder resin is preferably from 35° C. or about 35° C. to 100° C. or about 100° C., and more preferably from 50° C. or about 50° C. to 80° C. or about 80° C.

The glass transition temperature of the amorphous resin was determined from the peak temperature of the endotherm peak obtained by scanning differential calorimetry (DSC) described above.

The softening point of the binder resin is preferably present in the range of from 80° C. or about 80° C. to 130° C. or about 130° C., and more preferably in the range of from 90° C. or about 90° C. to 120° C. or about 120° C.

The softening point of the binder resin is measured by taking the median temperature between the melting initiation temperature and the melting completion temperature measured using a flow tester (trade name: CFT-500C, manufactured by Shimadzu Corp.) under the conditions of preheating at 80° C. for 300 seconds, at a plunger pressure of 0.980665 MPa, a die size of 1 mm-diameter×1 mm, and a rate of temperature increase of 3.0° C./min.

Next, the release agent will be explained.

The release agent may be used in an amount in the range of from 1% by mass % by weight to 10% by mass % by weight, and more preferably in the range of from 2% by mass % by weight to 8% by mass % by weight, among the components constituting the white toner particles.

The release agent may be a substance having a main maximum peak in the temperature range of from 50° C. to 140° C. as measured according to ASTM D3418-8.

In the measurement of the main maximum peak, for example, a differential scanning calorimeter (trade name: DSC-7, manufactured by Perkin Elmer, Inc.) is used. The temperature correction at the detection unit of this apparatus is carried out using the melting temperatures of indium and zinc, and the correction for calories is carried out using the heat of fusion of indium. The measurement is performed using an aluminum pan for the sample and using a blank pan for control, at a rate of temperature increase of 10° C./min.

The viscosity η1 at 160° C. of the release agent may be in the range of from 20 cps or about 20 cps to 600 cps or about 600 cps.

Specific examples of the release agent include low molecular weight polyolefins such as polyethylene, polypropylene and polybutene; silicones having a softening point by heating; fatty acid amides such as oleic acid amide, erucic acid amide, ricinolic acid amide and stearic acid amide; plant waxes such as carnauba wax, rice wax, candelilla wax, wood wax and jojoba oil; animal waxes such as beeswax; minerals such as montan wax, ozokerite, ceresin, paraffin wax, microcrystalline wax and Fischer-Tropsch wax; petroleum wax, and modification products thereof.

Next, other additives will be explained.

Examples of the other additives include various components such as a release agent, an internal additive, a charge control agent, an inorganic powder (inorganic particles), and organic particles.

Examples of the internal additive include metals, alloys, or magnetic bodies of compounds including these metals or the like, such as ferrite, magnetite, reduced iron, cobalt, nickel and manganese.

Examples of the inorganic particles include known inorganic particles, such as silica particles, titanium oxide particles, alumina particles, cerium oxide particles, or these particles with hydrophobization-treated surfaces. These inorganic particles may be subjected to various surface treatments, and for example, particles having their surfaces treated with a silane-based coupling agent, a titanium-based coupling agent, silicone oil or the like.

Next, the external additive will be explained.

The external additive may be, for example, inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$ and $MgSO_4$.

The surface of the external additive may be subjected to a hydrophobization treatment in advance. This hydrophobization treatment allows an improvement in the powder fluidity of the white toner particles, and is also effective in terms of the environmental dependency of electrical charging and resistance to carrier contaminability. The hydrophobization treatment is carried out by, for example, immersing the inorganic particles in a hydrophobization treating agent, or the like. The hydrophobization treating agent is not particularly limited, but examples include a silane-based coupling agent, silicone oil, a titanate-based coupling agent, an aluminum-based coupling agent, and the like. These may be used singly, or two or more kinds may be used in combination.

The externally added amount of the external additive may be, for example, from 0.5 parts by weight or about 0.5 parts by weight to 2.5 parts by weight or about 2.5 parts by weight relative to 100 parts by weight of the white toner particles.

Next, the properties of the white toner particles will be described.

The volume average particle size of the white toner particles is preferably in the range of from 4 μm or about 4 μm to 9 μm or about 9 μm.

The measurement of the volume average particle size is carried out using a size analyzer (trade name: MULTISIZER-II, manufactured by Beckman Coulter, Inc.), at an aperture diameter of 50 μm. At this time, the measurement is carried out after dispersing the toner in an aqueous solution of electrolyte (isotonic aqueous solution), and dispersing the dispersion by ultrasonication for 30 seconds or longer.

Next, the method for preparing the toner according to the exemplary embodiment of the present invention will be described.

First, toner particles may be produced by either a dry production method (for example, a kneading pulverization method), or a wet production method (for example, an agglomeration-unification method, a suspension polymerization method, a dissolution-suspension granulation method, a dissolution-suspension method, a dissolution-emulsification agglomeration-unification method). These production methods are not particularly limited, and any well known production method may be employed.

The white toner according to the exemplary embodiment is produced by, for example, adding an external additive to the obtained toner particles, and mixing them. The mixing is preferably carried out using, for example, a V-blender, a Henschel mixer, a Ledige mixer or the like. Furthermore, if necessary, coarse particles of the toner may be eliminated using a vibrating screening machine, an air screening machine or the like.

(Electrostatic Image Developing Agent)

The electrostatic image developing agent according to the exemplary embodiment contains at least the white toner according to the exemplary embodiment.

The electrostatic image developing agent according to the exemplary embodiment may be a single-component developing agent containing only the white toner according to the exemplary embodiment, or may be a two-component developing agent having the white toner and a carrier in mixture.

The carrier is not particularly limited, and any known carrier may be used. Examples of the carrier include a resin-coated carrier, a magnetically dispersed type carrier, a resin-dispersed type carrier, and the like.

In the two-component developing agent, the mixing ratio (weight ratio) of the toner according to the exemplary embodiment and the carrier is such that the ratio of toner: carrier is preferably in the range of about 1:100 to 30:100, and more preferably in the range of about 3:100 to 20:100.

(Toner Cartridge, Process Cartridge and Image Forming Apparatus)

The image forming apparatus according to the exemplary embodiment includes a first image forming unit that forms, on an image transfer receiver, a white toner image formed from the white toner according to the exemplary embodiment, and a second image forming unit that forms, on the image transfer receiver, a color image formed from a color toner for electrostatic image development.

The image forming apparatus according to the exemplary embodiment includes, respectively for these first and second image forming units, for example, a latent image retaining body; a developing unit that develops the electrostatic latent image formed on the latent image retaining body as a toner image using a toner; a transfer unit that transfer the toner image formed on the latent image retaining body to an image transfer receiver; if necessary, an extra unit such as a cleaning unit that cleans the transfer residual matters on the latent image retaining body; and a fixing unit that fixes the toner image (white toner image and color image) transferred to the image transfer receiver. Of course, the first and second image forming units may be constituted such that, for example, they share the image retaining body, the transfer unit or the like.

The image forming apparatus according to the exemplary embodiment may be, for example, an image forming apparatus that repeats primary transfer of each toner image retained on the latent image retaining body to an intermediate transfer receiver in sequence, or a tandem type image forming apparatus that has plural latent image retaining bodies respectively equipped with a developing unit for each color, disposed in series on an intermediate transfer receiver.

Here, the image forming apparatus according to the exemplary embodiment may have, for example, a cartridge structure in which the part including a developing unit that holds the electrostatic latent image developing agent according to the exemplary embodiment is attachable and detachable with respect to the image forming apparatus (process cartridge), or a cartridge structure in which the part that holds the white toner for electrostatic latent image development according to the exemplary embodiment as a supplementary toner to be supplied to the developing unit, is attachable and detachable with respect to the image forming apparatus (toner cartridge).

Herein after, the image forming apparatus according to the exemplary embodiment will be described with reference to the drawing.

FIG. 1 is a schematic constitutional diagram showing an example of the image forming apparatus according to the exemplary embodiment. The image forming apparatus according to the exemplary embodiment relates to a tandem type constitution in which plural photoreceptors, that is, plural image forming units, are provided as latent image retaining bodies.

The image forming apparatus according to the exemplary embodiment has, as shown in FIG. 1, four image forming units, 50Y, 50M, 50C and 50K, that respectively form a toner image of each of the yellow, magenta, cyan and black colors, and an image forming unit 50W that forms a white toner image are disposed in parallel (in tandem) with an interval therebetween. Each of the image forming units are arranged in the order of image forming units 50W, 50K, 50C, 50M and 50Y from the downstream side in the direction of rotation of the intermediate transfer belt 33.

Here, since the image forming units 50Y, 50M, 50C, 50K and 50W respectively have the same constitution except for the color of the toner in the developing agent contained therein, the image forming unit 50Y that forms a yellow image will be explained herein as a representative example. Furthermore, explanations on each of the image forming units 50M, 50C, 50K and 50W will be omitted, because the same explanations apply when the reference symbols of magenta (M), cyan (C), black (K) and white (W) are attached to the parts corresponding to the image forming unit 50Y, instead of the reference symbol yellow (Y). According to the exemplary embodiment, the white toner according to the exemplary embodiment will be used as the toner (white toner) in the developing agent contained in the image forming unit 50W.

The image forming unit 50Y for yellow color includes a photoreceptor 11Y as a latent image retaining body, and this photoreceptor 11Y is constructed to be rotary-driven by a driving unit (not depicted), along the direction of arrow A as depicted in the drawing at a predetermined process speed. As the photoreceptor 11Y, for example, use is made of an organic photoreceptor having sensitivity in the infrared region.

On the upper side of the photoreceptor 11Y, a charging roll (charging unit) 18Y is installed, and a predetermined voltage is applied on the charging roll 18Y by an electric power source (not depicted) so that the surface of the photoreceptor 11Y is charged to a predetermined potential.

On the periphery of the photoreceptor 11Y, an exposure apparatus (electrostatic latent image forming unit) 19Y that forms an electrostatic latent image by exposing the surface of the photoreceptor 11Y, is disposed further downstream to the charging roll 18Y along the direction of rotation of the photoreceptor 11Y. Furthermore, although an LED array which is capable of realizing miniaturization is used herein as the exposure apparatus 19Y owing to the problem of space, the exposure apparatus is not limited to this, and other electrostatic latent image forming units employing laser beams or the like may also be readily used.

On the periphery of the photoreceptor 11Y, a development apparatus (developing unit) 20Y that includes a developing agent retaining body for retaining the developing agent of yellow color, is disposed further downstream to the exposure apparatus 19Y along the direction of rotation of the photoreceptor 11Y. The development apparatus is constructed such that an electrostatic latent image formed on the surface of the photoreceptor 11Y is developed using the yellow color toner to thus form a toner image on the surface of the photoreceptor 11Y.

On the lower side of the photoreceptor 11Y, an intermediate transfer belt (primary transfer unit) 33 that is used for the primary transfer of the toner image formed on the surface of the photoreceptor 11Y is disposed across the lower side of the five photoreceptors 11Y, 11M, 11C, 11K and 11W. This intermediate transfer belt 33 is pressed against the surface of the photoreceptor 11Y by a primary transfer roll 17Y. Furthermore, the intermediate transfer belt 33 is extended by three rolls of a driving roll 12, a supporting roll 13 and a bias roll 14, and is constructed to move around along the direction of arrow 13 at the same speed of movement as the process speed of the photoreceptor 11Y. On the surface of the intermediate transfer belt 33, a toner image of yellow color is primary transferred, and the toner images of the respective colors of magenta, cyan, black and white are further primary transferred and laminated in sequence.

On the periphery of the photoreceptor 11Y, a cleaning apparatus 15Y for cleaning any residual toner or retransferred toner at the surface of the photoreceptor 11Y, is disposed further downstream to the primary transfer roll 17Y along the direction of rotation (direction of the arrow A) of the photoreceptor 11Y. The cleaning blade in the cleaning apparatus 15Y is installed so as to contact with the surface of the photoreceptor 11Y under pressure in the counter direction.

The bias roll 14 that extends the intermediate transfer belt 33, is contacted with a secondary transfer roll (secondary transfer unit) 34 under pressure, with the intermediate transfer belt 33 placed therebetween. The toner images which have been primary transferred and laminated on the surface of the intermediate transfer belt 33 are electrostatically transferred to the surface of a recording paper (image transfer receiver) P that is supplied from a paper cassette (not depicted), at the site of pressure contact between the bias roll 14 and the secondary transfer roll 34. At this time, because the toner images transferred and laminated on the intermediate transfer belt 33 are arranged such that the white toner image is placed at the top (uppermost layer), the toner images transferred onto the surface of the recording paper P are arranged to have the white toner image at the bottom (lowermost layer).

On the downstream of the secondary transfer roll 34, there is disposed a fixing machine (fixing unit) 35 for fixing the toner images that have been multi-transferred onto the recording paper P, to the surface of the recording paper P under heat and pressure and thereby forming a permanent image.

Examples of the fixing machine 35 include a fixing belt which has a belt shape and uses a low surface energy material, such as represented by a fluororesin component or a silicone resin, at the surface, and a cylindrically shaped fixing roll which uses a low surface energy material, such as represented by a fluororesin component or a silicone resin, at the surface.

Next, the operation of the image forming units 50Y, 50M, 50C, 50K and 50W that form images of the respective colors of yellow, magenta, cyan, black and white, will be described. Since the operation of each of the image forming units 50Y, 50M, 50C, 50K and 50W is the same, the operation of the image forming unit 50Y for yellow color will be described as a representative example.

In the developing unit 50Y for yellow images, the photoreceptor 11Y rotates in the direction of arrow A at a predetermined process speed. The surface of the photoreceptor 11Y is negatively charged to a predetermined potential by the charging roll 18Y. Thereafter, the surface of the photoreceptor 11Y is exposed by the exposure apparatus 19Y, and an electrostatic latent image is formed in accordance with the image data. Subsequently, the toner that has been negatively charged by the development apparatus 20Y is subjected to reversal development, and the electrostatic latent image formed on the surface of the photoreceptor 11Y is converted to a visible image at the surface of the photoreceptor 11Y, thereby a toner image being formed. Thereafter, the toner image on the surface of the photoreceptor 11Y is primary transferred to the surface of the intermediate transfer belt 33 by the primary transfer roll 17Y. After the primary transfer, the photoreceptor 11Y is cleaned as the transfer residual components such as the toner remaining on the surface of the photoreceptor are scraped out by the cleaning blade of the cleaning apparatus 15Y, and the photoreceptor 11Y is prepared for the subsequent image forming process.

The operation as discussed above is carried out for each of the image forming units 50Y, 50M, 50C, 50K and 50W, and the respective toner images converted to visible images on the surfaces of the photoreceptors 11Y, 11M, 11C, 11K and 11W are multi-transferred in sequence to the surface of the intermediate transfer belt 33. In the color mode, the toner images of the respective colors are multi-transferred in the order of yellow, magenta, cyan, black and white, while in the two-color mode or three-color mode, the toner images of required colors only are singly transferred or multi-transferred. Thereafter, the toner images that have been singly or multi-transferred to the surface of the intermediate transfer belt 33 are secondary transferred by the secondary transfer roll 34, to the surface of the recording paper P which has been conveyed from a paper cassette (not depicted), and subsequently, the transferred toner images are fixed when heated and pressed by the fixing machine 35. The toner remaining on the surface of the intermediate transfer belt 33 after the secondary transfer is cleaned by a belt cleaner 16, which is constituted of a cleaning blade for the intermediate transfer belt 33.

The image forming unit 50Y for yellow color is constituted of a process cartridge which integrates the development apparatus 20Y that includes a developing agent retaining body which retains an electrostatic latent image developing agent of yellow color, the photoreceptor 11Y, the charging roll 18Y, and the cleaning apparatus 15Y, and is attachable and detachable with respect to the main body of the image forming apparatus. The image forming units 50W, 50K, 50C and 50M are also constituted as process cartridges, similarly to the image forming unit 50Y.

Toner cartridges 40Y, 40M, 40C, 40K and 40W are cartridges which hold the toners of the respective colors and are attachable and detachable with respect to the image forming apparatus. The toner cartridges are connected to the development apparatuses correspondingly to the respective colors, through toner supply pipes that are not depicted. When the toner contained in each of the toner cartridges is reduced in amount, this toner cartridge is exchanged.

EXAMPLES

Hereinafter, the exemplary embodiment will be more specifically described in detail by way of Examples and Comparative Examples, but the exemplary embodiment is not intended to be limited to these Examples.

(Preparation of Polyester Resin Dispersion Liquid)

Terephthalic acid: 30 mol %

Fumaric acid: 70 mol %

Bisphenol A ethylene oxide 2-mol adduct: 20 mol %

Bisphenol A propylene oxide 2-mol adduct: 80 mol %

The monomers shown above are introduced into a flask having an internal capacity of 5 liters and equipped with a stirring device, a nitrogen inlet tube, a temperature sensor and a rectification column, and the temperature is raised to 190° C. over one hour. After it is confirmed that the reaction system is being stirred inside, 1.2 parts by massparts by weight of dibutyltin oxide is introduced thereto.

Furthermore, while generated water is distilled off, the temperature is raised to 240° C. from the same temperature over 6 hours, and a dehydration condensation reaction is continued for 3 hours at 240° C. Thus, a polyester resin having an acid value of 12.0 mg/KOH and a weight average molecular weight of 9700 is obtained (amorphous polyester resin 1).

Subsequently, while this resin is in a molten state, the resin is transported to a CAVITRON CD1010 (trade name, manufactured by Eurotec, Ltd.) at a rate of 100 g per minute.

Dilute aqueous ammonia at a concentration of 0.37% by mass % by weight, which has been prepared by diluting reagent aqueous ammonia with ion-exchanged water, is in a separately prepared aqueous medium tank, and while the dilute aqueous ammonia is heated to 120° C. with a heat exchanger, the dilute aqueous ammonia is transported, together with the molten body of the amorphous polyester resin 1, to a CAVITRON CD1010 (trade name, manufactured by Eurotec, Ltd.).

The Cavitron is operated under the conditions at a speed of rotation of the rotor of 60 Hz and a pressure of 5 kg/cm$^2$. Thus, a resin dispersion liquid formed from a polyester resin having an average particle size of 160 nm and a solids content of 30 parts by weight, is obtained.

(Preparation of Releasing Dispersion Liquid)

—Release Agent Dispersion Liquid Components—

Paraffin wax (trade name: HNP9, manufactured by Nippon Seiro Co., Ltd.; melting temperature 75° C.): 45 parts by weight Cationic surfactant (trade name: NEOGEN RK, manufactured by Daiichi Kogyo Seiyaku Co., Ltd.): 5 parts by weight Ion-exchanged water: 200 parts by weight The above release agent dispersion liquid components are heated to 95° C., and the mixture is dispersed with a homogenizer (trade name: ULTRATARAX T50, manufactured by IKA Werke GmbH & Co. KG) and then subjected to a dispersion treatment with a pressure ejection type Gaulin homogenizer. Thus, a release agent dispersion liquid having a median diameter of 200 nm and a solids content of 20 parts by weight is obtained.

(Preparation of First White Pigment Dispersion Liquid)

—Preparation of White Pigment Dispersion Liquid (A1)—

Rutile type titanium oxide (trade name: CR-60-2, manufactured by Ishihara Sangyo Kaisha, Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 210 nm is dispersed, is prepared.

—Preparation of White Pigment Dispersion Liquid (A2)—

Anatase type titanium oxide (trade name: A-220, manufactured by Ishihara Sangyo Kaisha, Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 160 nm is dispersed, is prepared.

—Preparation of White Pigment Dispersion Liquid (A3)—

Zinc oxide (zinc oxide special No. 1, manufactured by HakusuiTech, Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 330 nm is dispersed, is prepared.

—Preparation of White Pigment Dispersion Liquid (A4)—

Potassium titanate (trade name: TISMO D, manufactured by Otsuka Chemical Co., Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 450 nm is dispersed, is prepared.

—Preparation of White Pigment Dispersion Liquid (A5)—

White lead (trade name: DR-46000 KREMNITS WHITE, manufactured by Dr. KREMER): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 500 nm is dispersed, is prepared.

(Preparation of Second White Pigment Dispersion Liquid)

—Preparation of White Pigment Dispersion Liquid (B1)—

Hollow silica (trade name: SILINAX, manufactured by Nittetsu Mining Co., Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 100 nm is dispersed, is prepared.

—Preparation of White Pigment Dispersion Liquid (B2)—

Hollow crosslinked styrene/acrylic resin particles (trade name: SX866(A), manufactured by JSR Corp.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 300 nm is dispersed, is prepared.

—Preparation of White Pigment Dispersion Liquid (B3)—

Carboxylated styrene-butadiene copolymer resin particles (trade name: LX407BP, manufactured by Nippon Zeon Co., Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 50% by weight), in which a white pigment having a volume average particle size of 400 nm is dispersed, is prepared.

—Preparation of White Particles Dispersion Liquid (B4)—

Silica (trade name: SP-03F, manufactured by Fuso Chemical Co., Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thus, a white pigment dispersion preparation (solids concentration: 30% by weight), in which a white pigment having a volume average particle size of 300 nm is dispersed, is prepared.

—Preparation of White Pigment Dispersion Liquid (B5)—

Hollow crosslinked styrene/acrylic resin particles (trade name: SX8782(P), manufactured by JSR Corp.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 1100 nm is dispersed, is prepared.

—Preparation of White Pigment Dispersion Liquid (B6)—

Ethylene bismelamine resin particles (trade name: SHIGENOX OWP, manufactured by Hakkol Chemical Co., Ltd.): 210 parts by weight Nonionic surfactant (trade name: NONIPOL 400, manufactured by Sanyo Chemical Industries, Ltd.): 10 parts by weight Ion-exchanged water: 480 parts by weight The above components are mixed and dissolved, and the mixture is stirred for 30 minutes using a homogenizer (trade name: ULTRATARAX T50, manufactured by IKA Werke GmbH & Co. KG). Thereafter, the resultant is subjected to a dispersion treatment for one hour with a high pressure impact type dispersing machine (trade name: ULTIMIZER HJP30006, manufactured by Sugino Machine, Ltd.). Thus, a white pigment dispersion preparation (solids concentration: 30% by weight), in which a white pigment having a volume average particle size of 500 nm is dispersed, is prepared.

Example 1

| | |
|---|---|
| Ion-exchanged water: | 450 parts by weight |
| Polyester resin dispersion liquid: | 410 parts by weight |
| Release agent dispersion liquid: | 100 parts by weight |
| Anionic surfactant: | 2.8 parts by weight |

(trade name: NEOGEN RK, manufactured by Daiichi Kogyo Seiyaku Co., Ltd.; 20% by weight)

The above components are placed in a 3-liter reaction vessel equipped with a thermometer, a pH meter, and a stirrer, and while the temperature is externally controlled by a mantle heater, the mixture is maintained for 30 minutes at a temperature of 30° C. and a speed of rotation of the stirrer of 150 rpm.

Next, white pigment dispersion liquids shown below are introduced into this emulsion, and the mixture is maintained for 5 minutes. While the mixture is left untouched, a 1.0% by weight aqueous solution of nitric acid is added, and the pH in the agglomeration process is adjusted to 3.0.

White pigment dispersion liquid (A1): 275 parts by weight (equivalent to 30% by weight in toner particles)

White pigment dispersion liquid (B1): 165 parts by weight (equivalent to 10% by weight in toner particles)

Next, while the emulsion added with the white pigment dispersion liquids is dispersed with a homogenizer (trade name: ULTRATARAX T50, manufactured by IKA Werke GmbH & Co. KG), 0.4 parts by weight of polyaluminum chloride is added thereto. Subsequently, while the mixture is stirred, the temperature is increased to 50° C., and the particle size is measured with a [TA-II] type Coulter counter (aperture diameter: 50 μm, manufactured by Beckman Coulter, Inc.). The volume average particle size is found to be 5.5 μm. Thereafter, 183 parts by weight of the polyester resin dispersion liquid is additionally added thereto, so that the resin particles are attached to the surface of the agglomerate particles.

Subsequently, the pH is adjusted to 9.0 by using a 5% by weight aqueous solution of sodium hydroxide. Then, the temperature is increased to 90° C. at a rate of temperature increase of 0.05° C./min, and the particles are maintained for 3 hours at 90° C. and then cooled. The particles are filtered, further redispersed in ion-exchanged water, and filtered. The particles are repeatedly washed until the electric conductivity of the liquid reaches 20 μS/cm or less, and then are dried in a vacuum for 5 hours in an oven at 40° C. Thus, white toner particles are obtained.

Subsequently, 1.5 parts by weight of hydrophobic silica (trade name: RY50, manufactured by Nippon Aerosil Co., Ltd.) is blended with 100 parts by weight of the obtained toner particles using a sample mill for 30 seconds at 10,000 rpm. The mixture is then sieved with a vibrating screen with a mesh size of 45 μm, and thus a white toner is prepared. The volume average particle diameter of the obtained white toner particles is 6.1 μm.

Subsequently, 4 parts by weight of the obtained white toner and 96 parts by weight of Carrier A shown below are mixed and stirred for 5 minutes with a V-type blender, and thus a developing agent is produced.

—Carrier A—

Ferrite particles (manufactured by PowderTech, Ltd.; volume average particle size 35 μm): 100 parts by weight Toluene: 14 parts by weight Perfluorooctylethyl acrylate/methyl methacrylate copolymer (copolymerization ratio=40:60, weight average molecular weight Mw=50,000): 0.8 parts by weight Carbon black (trade name: VXC-72, manufactured by Cabot Corp.): 0.06 parts by weight Crosslinked melamine resin particles (number average particle size: 0.3 μm): 0.15 parts by weight Among the above components, the components except for the ferrite particles are dispersed with a stirrer for 10 minutes, and a liquid for coating formation is prepared. This liquid for coating formation and the ferrite particles are introduced into a vacuum degassing-type kneader, and the mixture is stirred for 30 minutes at 60° C. Toluene is distilled off under reduced pressure, and thereby a resin coating is formed on the surface of the ferrite particles. Thus, the carrier is produced.

Examples 2 to 9 and Comparative Examples 1 to 7

White toners are produced in the same manner as in Example 1, except that the type and amount of addition of the white pigment dispersion liquid is changed to obtain the combinations and contents according to Table 1. These white toners are used to prepare developing agents.

Comparative Example 8

| | |
|---|---|
| Ion-exchanged water: | 450 parts by weight |
| Polyester resin dispersion liquid: | 410 parts by weight |
| Release agent dispersion liquid: | 100 parts by weight |
| Anionic surfactant: | 2.8 parts by weight |

(trade name: NEOGEN RK, manufactured by Daiichi Kogyo Seiyaku Co., Ltd.; 20% by weight)

The above components are placed in a 3-liter reaction vessel equipped with a thermometer, a pH meter, and a stirrer, and while the temperature is externally controlled by a mantle heater, the mixture is maintained for 30 minutes at a temperature of 30° C. and a speed of rotation of the stirrer of 150 rpm.

Next, a white pigment dispersion liquid shown below is introduced into this emulsion, and the mixture is maintained for 5 minutes. While the mixture is left untouched, a 1.0% by weight aqueous solution of nitric acid is added, and the pH in the agglomeration process is adjusted to 3.0.

White pigment dispersion liquid (A1): 440 parts by weight (equivalent to 40% by weight in toner particles)

Next, while the emulsion added with the white pigment dispersion liquids is dispersed with a homogenizer (trade name: ULTRATARAX T50, manufactured by IKA Werke GmbH & Co. KG), 0.4 parts by weight of polyaluminum chloride is added thereto. Subsequently, while the mixture is stirred, the temperature is increased to 50° C., and the particle size is measured with a [TA-II] type Coulter counter (aperture diameter: 50 μm, manufactured by Beckman Coulter, Inc.). The volume average particle size is found to be 5.5 μm. Thereafter, 183 parts by weight of the polyester resin dispersion liquid is additionally added thereto, so that the resin particles are attached to the surface of the agglomerate particles.

Subsequently, the pH is adjusted to 9.0 by using a 5% by weight aqueous solution of sodium hydroxide. Then, the temperature is increased to 90° C. at a rate of temperature increase of 0.05° C./min, and the particles are maintained for 3 hours at 90° C. and then cooled. The particles are filtered, further redispersed in ion-exchanged water, and filtered. The particles are repeatedly washed until the electric conductivity of the liquid reaches 20 μS/cm or less, and then are dried in a vacuum for 5 hours in an oven at 40° C. Thus, white toner particles are obtained.

Subsequently, 1.5 parts by weight of hollow silica (trade name: SILINAX, manufactured by Nittetsu Mining Co., Ltd.) is blended with 100 parts by weight of the obtained toner particles using a sample mill for 30 seconds at 10,000 rpm. The mixture is then sieved with a vibrating screen with a mesh size of 45 μm, and thus a white toner is prepared. The volume average particle diameter of the obtained white toner particles is 6.1 μm.

Subsequently, 4 parts by weight of the obtained white toner and 96 parts by weight of the Carrier A are mixed and stirred for 5 minutes with a V-type blender, and thus a developing agent is produced.

(Evaluation)

The developing agents making use of the white toners obtained in the respective Examples are mounted in a modified copying machine (trade name: DOCUCENTER COLOR F450, manufactured by Fuji Xerox Co., Ltd.; modified by adding an imaging unit for white image formation to a 4-drum tandem), and printing is carried out using paper T manufactured by Fuji Xerox Co., Ltd., after adjusting the toner weight on the paper under an environment at 23° C. and 55%, to be 0.7 mg/cm$^2$.

Furthermore, images (solid images having a size of 30 mm×40 mm) for the evaluation of white color (image density coverage 100%) are printed, and while the fixation temperature is set at 160° C., the images are evaluated for the flexural strength (fixability) and image cracks (mechanical strength). The results are presented in Table 1.

—Flexural Strength (Fixability)—

The image surface at the solid image part is folded using a weight of a certain load, and the folded part is scraped with gauze. The degree of image defects generated by the scraping is visually observed and evaluated based on the following criteria.

G1: When the image is scraped with gauze, those areas other than the folded part also develop image defects at the same time, so that most of the image is not fixed.

G2: When the image is scraped with gauze, image defects occur such that the folded part and the vicinity turn into wide white lines.

G3: When the image is scraped with gauze, image defects occur such that the folded part turns into a white line, while the vicinal areas also have cracks or the like.

G4: When the image is scraped with gauze, image defects occur such that only the folded part turns into a very fine white line. A level practically free of problem.

G5: When the image is scraped with gauze, there is almost no image defect, which is present only to the extent that the history of folding is realized.

—Image Cracks (Mechanical Strength)—

The solid image part is wound around 5 types of metal rolls having different radii (radius=40 mm, 30 mm, 20 mm, 10 mm and 5 mm), using the rolls in sequence from one with a larger diameter to one with a smaller diameter. The presence or absence of cracks is visually observed, and the minimum radius that does not cause cracks is investigated and evaluated based on the following criteria.

A: The minimum radius of the metal roll that does not cause cracks is smaller than 10 mm.

B: The minimum radius of the metal roll that does not cause cracks is 10 mm or larger and smaller than 30 mm.

C: The minimum radius of the metal roll that does not cause cracks is 30 mm or larger.

TABLE 1

| | First white particle dispersion liquid | | | Second white particle dispersion liquid | | | Total amount of | | |
|---|---|---|---|---|---|---|---|---|---|
| | Type of dispersion liquid | Pigment specific gravity | Amount of pigment in toner particles (solid contents; % by weight) | Type of dispersion liquid | Pigment specific gravity | Amount of pigment in toner particles (solid contents; % by weight) | pigments in toner particles (solid contents; % by weight) | Flexural strength (fixability) | Image cracks (mechanical strength) |
| Example 1 | A1 | 4.2 | 25 | B1 | 0.6 | 15 | 40 | G5 | A |
| Example 2 | A2 | 3.7 | 25 | B1 | 0.6 | 15 | 40 | G4 | A |
| Example 3 | A3 | 5.6 | 25 | B1 | 0.6 | 15 | 40 | G4 | B |

TABLE 1-continued

| | First white particle dispersion liquid | | | Second white particle dispersion liquid | | | Total amount of | | |
|---|---|---|---|---|---|---|---|---|---|
| | Type of dispersion liquid | Pigment specific gravity | Amount of pigment in toner particles (solid contents; % by weight) | Type of dispersion liquid | Pigment specific gravity | Amount of pigment in toner particles (solid contents; % by weight) | pigments in toner particles (solid contents; % by weight) | Flexural strength (fixability) | Image cracks (mechanical strength) |
| Example 4 | A1 | 4.2 | 25 | B2 | 0.4 | 15 | 40 | G4 | A |
| Example 5 | A1 | 4.2 | 25 | B3 | 1.0 | 15 | 40 | G4 | B |
| Example 6 | A1 | 4.2 | 10 | B1 | 0.6 | 10 | 20 | G5 | A |
| Example 7 | A1 | 4.2 | 30 | B1 | 0.6 | 20 | 50 | G4 | B |
| Comparative Example 1 | A1 | 4.2 | 40 | — | — | — | 40 | G1 | C |
| Comparative Example 2 | — | — | — | B1 | 0.6 | 40 | 40 | G1 | C |
| Comparative Example 3 | A1 | 4.2 | 25 | B4 | 2.2 | 15 | 40 | G2 | B |
| Comparative Example 4 | A4 | 3.4 | 25 | B1 | 0.6 | 15 | 40 | G2 | B |
| Comparative Example 5 | A5 | 6.6 | 25 | B1 | 0.6 | 15 | 40 | G2 | B |
| Comparative Example 6 | A1 | 4.2 | 25 | B5 | 0.2 | 15 | 40 | G2 | B |
| Comparative Example 7 | A1 | 4.2 | 25 | B6 | 1.4 | 15 | 40 | G2 | B |
| Example 8 | A1 | 4.2 | 10 | B1 | 0.6 | 5 | 15 | G5 | A |
| Example 9 | A1 | 4.2 | 40 | B1 | 0.6 | 20 | 60 | G3 | B |
| Comparative Example 8 | A1 | 4.2 | 40 | Hollow silica is externally added to the toner particles | | | 40 | G2 | C |

From the results shown above, it can be seen that the Examples of the invention may all give satisfactory results for the flexural strength (fixability) and image cracks (mechanical strength) as compared with Comparative Examples.

In addition, while Example 8 is poor in concealability due to the smallness of the total pigment amount, preferable results are obtained in terms of flexural strength or image cracks in Example 8. This is because flexural strength or image cracks are less affected due to the small total pigment amount of pigments.

What is claimed is:

1. A white toner for electrostatic image development, comprising a binder resin, a first white pigment and a second white pigment, wherein the specific gravity D1 of the first white pigment satisfies the relationship about 3.5<D1<about 6.0, and the specific gravity D2 of the second white pigment satisfies the relationship about 0.3<D2<about 1.2, wherein the second white pigment is a pigment having a hollow structure.

2. The white toner for electrostatic image development of claim 1, wherein the content of the first white pigment is larger than the content of the second white pigment, and the total content of the first white pigment and the second white pigment is from about 20% by weight to about 50% by weight with respect to the total solid content of the white toner.

3. The white toner for electrostatic image development of claim 1, wherein the content ratio of the first white pigment and the second white pigment (first white pigment:second white pigment) is from 1:1 to 4:1 on a weight basis.

4. The white toner for electrostatic image development of claim 1, wherein the content of the first white pigment is from 10% by weight to 30% by weight.

5. The white toner for electrostatic image development of claim 1, wherein the content of the second white pigment is from about 10% by weight to about 30% by weight.

6. The white toner for electrostatic image development of claim 1, wherein the volume average particle sizes of the first white pigment and the second white pigment are about 1 μm or less, respectively.

7. The white toner for electrostatic image development of claim 1, wherein the glass transition temperature of the binder resin is from about 35° C. to about 100° C.

8. The white toner for electrostatic image development of claim 1, wherein the softening point of the binder resin is from about 80° C. to about 130° C.

9. The white toner for electrostatic image development of claim 1, wherein the toner further comprises a release agent and the viscosity η1 at 160° C. of the release agent is from about 20 cps to about 600 cps.

10. The white toner for electrostatic image development of claim 1, wherein the toner further comprises am external additive, the externally added amount of the external additive is from about 0.5 parts by weight to about 2.5 parts by weight relative to 100 parts by weight of the white toner particles.

11. The white toner for electrostatic image development of claim 1, wherein the volume average particle size of the white toner particles is from about 4 μm to about 9 μm.

12. An electrostatic image developing agent, comprising at least the white toner for electrostatic image development of claim 1.

* * * * *